US006588753B2

(12) United States Patent
Callaway, Jr.

(10) Patent No.: US 6,588,753 B2
(45) Date of Patent: Jul. 8, 2003

(54) METHOD OF PLAYING A VARIATION OF CHECKERS BOARD GAME

(76) Inventor: Lemar Callaway, Jr., 716 Skipwith Rd., Virginia Beach, VA (US) 23464

( * ) Notice: Subject to any disclaimer, the term of this patent is extended or adjusted under 35 U.S.C. 154(b) by 0 days.

(21) Appl. No.: 09/809,057

(22) Filed: Mar. 16, 2001

(65) Prior Publication Data

US 2002/0130466 A1 Sep. 19, 2002

(51) Int. Cl.[7] ..... A63F 3/00
(52) U.S. Cl. ..... 273/258; 273/236; 273/261
(58) Field of Search ..... 273/260, 261, 273/266, 242, 262, 255, 236, 258

(56) References Cited

U.S. PATENT DOCUMENTS

| | | | | |
|---|---|---|---|---|
| 486,471 A | | 11/1892 | Hunsberger | |
| 1,152,360 A | | 8/1915 | Tejera | |
| 1,509,678 A | | 9/1924 | McPherson et al. | |
| 1,525,944 A | | 2/1925 | Marteka | |
| 5,803,457 A | * | 9/1998 | Smith | 273/261 |
| 6,135,452 A | * | 10/2000 | Yurchey | 273/260 |

* cited by examiner

*Primary Examiner*—Benjamin H. Layno
*Assistant Examiner*—V K Mendiratta

(57) ABSTRACT

A variation on checkers style games wherein each player has an initial holding of twelve playing pieces. The board includes an array of four columns and eight rows of playing locations, wherein one playing location may be occupied by only one playing piece. The goal of the game for each player is to achieve removal of one's own playing pieces by forcing the opponent to jump one's own pieces. Playing pieces, which initially cannot move backwardly and laterally, are promoted to be able to move laterally once moving past the forwardmost row of their initial board positions, and to be able to move backwardly when they reach a corresponding row of the opponent's playing pieces. Jumps are generally mandatory, although players have the option of accepting a penalty in the form of restoring playing pieces to the board in place of making an otherwise mandatory jump. An opponent whose pieces have prevented the other player from making a move must, at his or her next turn, make a move which removes obstruction from a piece of the immobilized player's pieces. In a certain specified situation wherein only two opposing pieces remain on the board, and one player must avoid moving forwardly to avoid affording a winning move to the other player, victory is awarded to the player who has forced his or her opponent to avoid moving forwardly.

20 Claims, 4 Drawing Sheets

METHOD OF PLAYING A VARIATION OF CHECKERS BOARD GAME

BACKGROUND OF THE INVENTION

1. Field of the Invention

The present invention relates to board games, and more particularly to games in which playing pieces move over the board and are removed as the game progresses.

2. Description of the Prior Art

Board games have long been played for entertainment. The game of checkers is one of the best known examples. In checkers, each of two players alternatingly move their pieces, one piece per move. The object of checkers is to remove or trap the opponent's playing pieces.

Although checkers has provided considerable entertainment over the years, the game playing public periodically yearns for new forms of entertainment, but clings to traditional game formats. Therefore, variations on the traditional game of checkers have been proposed.

U.S. Pat. No. 1,509,678, issued to John F. McPherson et al. on Sep. 23, 1924, shows a board game generally similar to checkers, wherein pieces are moved from node to node on a grid printed on the board. Game layout and number and move options of individual playing pieces of McPherson et al. vary significantly from those of the present invention.

U.S. Pat. No. 1,525,944, issued to Anthony Marteka on Feb. 10, 1925, shows a board game wherein the object of the game is removal of one's own pieces. However, Marteka uses a device of chance to influence a player's move options. By contrast, the player of the present invention has full discretion within prescribed limits of moves of each piece to influence his or her own move.

U.S. Pat. Nos. 486,471, issued to Abram C. Hunsberger on Nov. 22, 1892, and 1,152,360, issued to Carlos Eduardo Tejera on Aug. 31, 1915, each show a fanciful variation of the conventional game of checkers. Game apparatus and moves differ from those of the present invention.

None of the above inventions and patents, taken either singly or in combination, is seen to describe the instant invention as claimed.

SUMMARY OF THE INVENTION

The present invention provides a variation on checkers style games, but obliges players to adopt strategies opposite those of conventional checkers style games, and to master new strategies. A notable example of departure from conventional strategies is that the goal of the game for each player is to achieve removal of one's playing pieces by forcing the opponent to jump one's own pieces.

A second departure from conventional practice is that pieces are promoted to those able to move backwardly, taken with regard to the initial permitted direction of moves, when they reach a point on the board short of the last row. A further example is that while jumps are generally mandatory players have the option of accepting a penalty in place of making an otherwise mandatory jump. Still another example is that a certain situation wherein only two opposing pieces remain on the board, which situation would result in a draw in conventional checkers, gives victory to one specified player. Yet another example is the requirement that the opponent whose pieces have prevented the other player from making a move must, at his or her next turn, make a move which removes obstruction from a piece of the immobilized player's pieces.

Accordingly, it is an object of the invention to provide a game generally similar to checkers, which game features strategies varied from those of checkers and other like games.

This and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
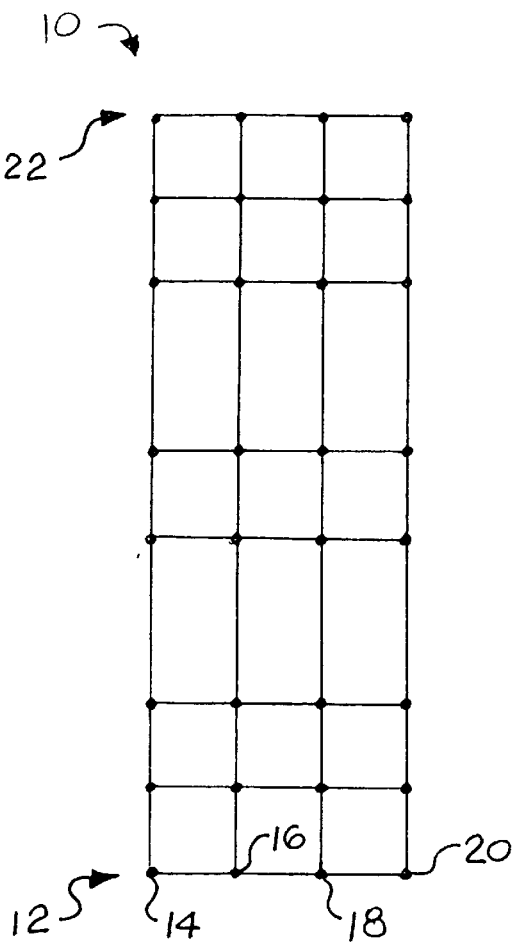
FIG. 1 is a top plan view of a playing board for the novel game.
Figure 2:
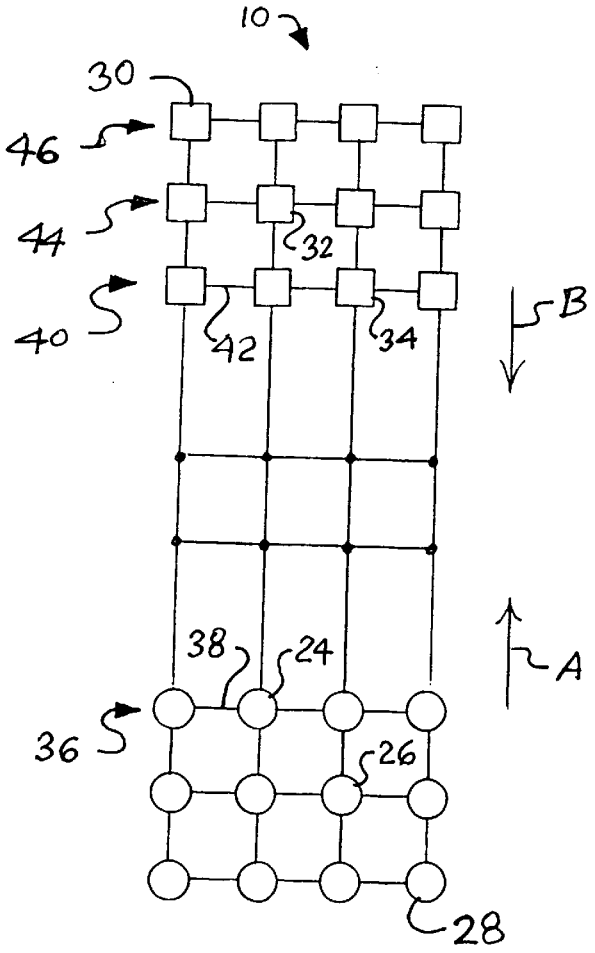
FIG. 2 is a top plan view of the board of FIG. 1, with playing pieces shown in their initial locations.

FIG. 1 of the drawings shows a board 10 on which is inscribed or otherwise formed an array of playing locations each individually occupiable by one playing piece (see FIG. 2). Each playing location occurs at the intersection of horizontal and vertical lines appearing on board 10. Illustratively, a row 12 of playing locations occur where indicated by 14, 16, 18, 20. Obviously, twenty-eight additional playing locations (not individually identified by reference numerals in FIG. 1) are also provided in the array depicted. The array is ordered such that there are four columns of eight playing locations, and eight rows of four playing locations, providing thirty-two total playing locations. Of course, the arrangement incorporating intersections of lines is only one graphical representation of many which would result in providing rows and columns of playing locations. An exemplary alternative would be to provide an equivalent number of spaces bounded by lines, in the manner of a conventional checker board. The precise graphical method of establishing playing locations is unimportant, except that a pattern of serially arranged playing locations must be provided enabling moves from each playing location selectively along at least two paths. Similarly, it is not critical that the array be inscribed on a board such as a traditional thin, generally rigid playing board, which could have just one panel or alternatively plural panels optionally hinged to one another. As an alternative, the array could be inscribed on a stationary surface such as a table top, counter top, bar top, or inscribed on a floor surface or other horizontal environmental surface.

Row 12 establishes one end of the array of playing locations. A corresponding row 22 establishes the other end of the array. The second end is that end of the array or playing field which is maximally spaced apart from the first end by playing locations. Each of the two players is provided with twelve initial playing pieces which are visually distinguishable from the initial playing pieces of the other player. Playing pieces may take any form. They may, for example, comprise colored discs (not shown), or alternatively may be miniature simulations of recognizable objects such as animals and people.

Turning now to FIG. 2, the twelve initial playing pieces of each player are placed on playing locations at one of the two ends of the array, as shown. Playing pieces 24, 26, 28 represent three arbitrarily selected ones of the twelve playing pieces of one player, and are graphically represented for purposes of explanation herein by circles. Playing pieces 30, 32, 34 represent three arbitrarily selected ones of the twelve playing pieces of the other player, and are graphically represented as squares.

Play is then conducted, wherein the players alternatingly undertake moves with their respective playing piece. Each move is limited to moving one playing piece. The playing piece making a move, may move a distance of one playing location to an adjacent unoccupied playing location. An exception to this limitation is when jumping opponent's playing pieces, as is described hereinafter. The goal of the game for each player is to have all of his or her playing pieces removed from the array, and hence from play. This is accomplished when a first player forces the second player, or opponent, to jump all the playing pieces of the first player. Under most circumstances, and within the following rules, jumps are mandatory. All jumped pieces are removed from play.

This is done subject to the following constraints. Each initial playing piece is constrained to move a distance on the array of one and only one playing location when only unoccupied playing locations are adjacent to the playing location of the initial playing piece undertaking a move. An initial playing piece may not move to an occupied playing location. Each initial playing piece must move only forwardly until it has passed the row of forwardmost playing locations occupied initially by its own playing pieces. An exception to this rule is that an initial playing piece can jump backwardly or alternatively, laterally when an opponent's playing piece is appropriately adjacent, and a free or unoccupied space is so located that a jump may legally be made, as is discussed hereinafter. If this situation occurs, it will be in the advanced stages of the game.

For the player having playing pieces depicted as circular, this is row 36, where row 36 is shown as a row of four playing pieces including playing piece 24, the four playing pieces and their respective playing locations being connected by straight line 38. The forward direction for the player having circular pieces is indicated by arrow A. For the player having playing pieces depicted as square, the corresponding row is row 40, comprising those playing positions connected by line 42 and including playing piece 34. The forward direction for the player having square pieces is indicated by arrow B. Once a playing piece has moved past row 36 or 40, it can then move selectively laterally or forwardly one playing location per move.

Initial playing pieces remain constrained to move only laterally and forwardly to unoccupied playing locations until they have moved to spaces initially occupied by the opponent's initial playing pieces. The forwardmost row initially occupied by playing pieces demarcates a promotion area for the opponent which when occupied empowers ability to move backwardly as well as laterally and forwardly. The promotion area comprises the end row initially occupied by the opponent and also one or more adjacent rows of playing positions. Illustratively, for the player having pieces shown as circular, row 40 demarcates the promotion area including rows 40, 44, and 46. That is, a playing piece which is moved from the opposing player's playing pieces to any one of rows 40, 44, and 46 is said to be promoted. Of course, playing conditions described with reference to the end of the array including row 22 in FIG. 1 apply equally to the end of the array including row 12 (or row 46 in FIG. 2), in that the board and playing conditions are considered as a mirror image situation so that both players confront identical conditions of play prior to the first move.

When any circular initial playing piece is moved at least to row 40, or beyond to row 44 or row 46, that playing piece is promoted, or is empowered to move selectively backwardly one playing location per move as well as forwardly and laterally. This ability is immediately conferred, and may for example occur in the midst of a move. For example, a playing piece may jump over the opponent's playing pieces, reach row 40, and continue to jump additional playing pieces, where such continuation of the move is made possible by promotion. In other respects, such as distance moved and inability to move to occupied playing locations, moves for promoted playing pieces continue to be governed by prior constraints.

Figure 3:
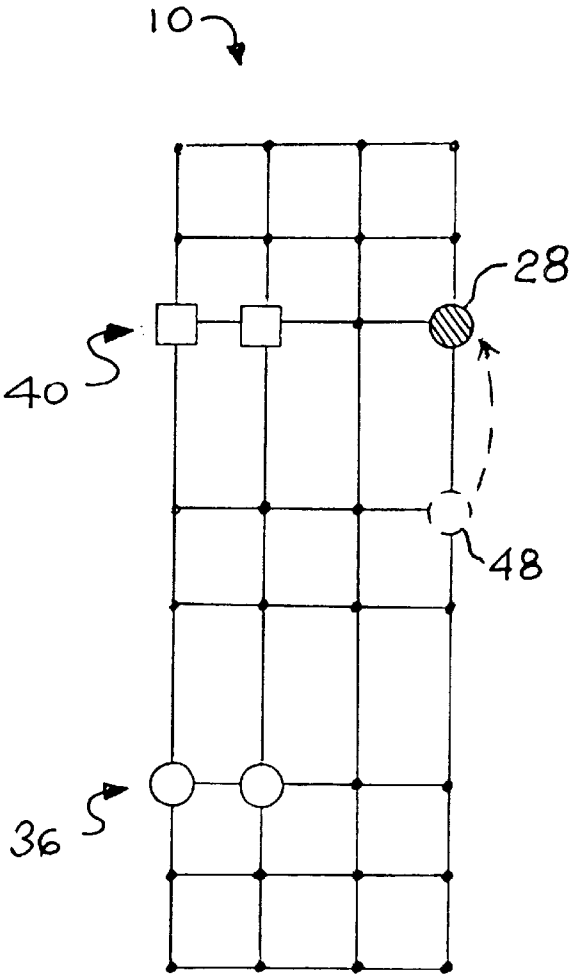
FIG. 3 is a top plan view of the board of FIG. 1, showing an advanced stage of play, and illustrating a simple move.

FIG. 3 depicts an ordinary move which results in promotion. The ordinary move is an advance by playing piece 28 a distance of one playing location. The initial position of playing piece prior to the move is represented by broken lines as position 48. The final position after the move, shown in solid lines, is indicated by playing piece 28. Because attainment of row 40 results in promotion, playing piece 28 is changed to a visually recognizable form shown symbolically by shading. In actual practice, the playing piece, if provided in the form of a colored disc or other colored object, may be overturned, rotated, or otherwise repositioned to reveal a new color or indicia not visible in the original orientation. Alternatively, an entirely different visually distinct piece may be substituted.

Figure 4:
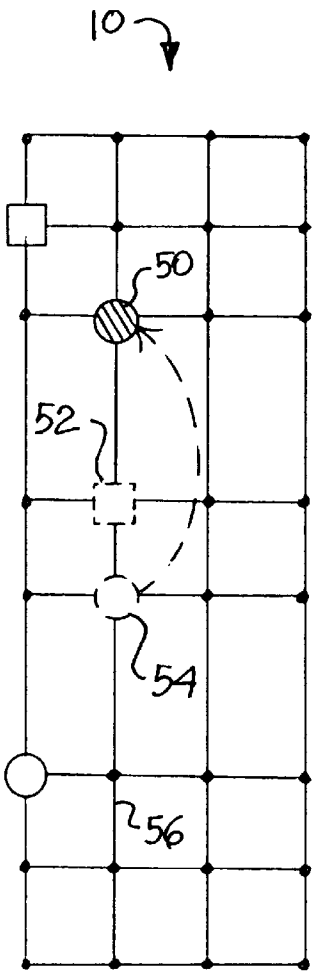
FIG. 4 is a top plan view of the board of FIG. 1, showing an advanced stage of play, and illustrating a simple jump.

FIG. 4 illustrates a jump move. An initial playing piece, such as playing piece 50, is required to jump over an opposing playing piece, such as playing piece 52, when the opposing playing piece occupies a playing location adjacent to that of the initial playing piece undertaking the move, and when an unoccupied playing location exists adjacent to the playing piece being jumped along the same column or row occupied by the playing piece undertaking the jump move and the playing piece being jumped. In the example of FIG. 4, it will be seen that playing piece 52 initially occupied a playing location adjacent to that initially occupied by playing piece 50. The initial position of playing piece 50 is shown in broken lines, and is designated as 54. Immediately after a jump move, the moving piece occupies the playing location adjacent to the jumped piece. The jump is permitted only along a row or column. In the present example, initial playing location 54, jumped piece 52, and the formerly unoccupied playing location occupied by playing piece 50 after the jump are all located along the column indicated by line 56. The distance negotiated by playing piece 50 is two playing locations. Jumps are mandatory regardless of whether the playing pieces being jumped are initial playing pieces or are promoted playing pieces.

Figure 5:
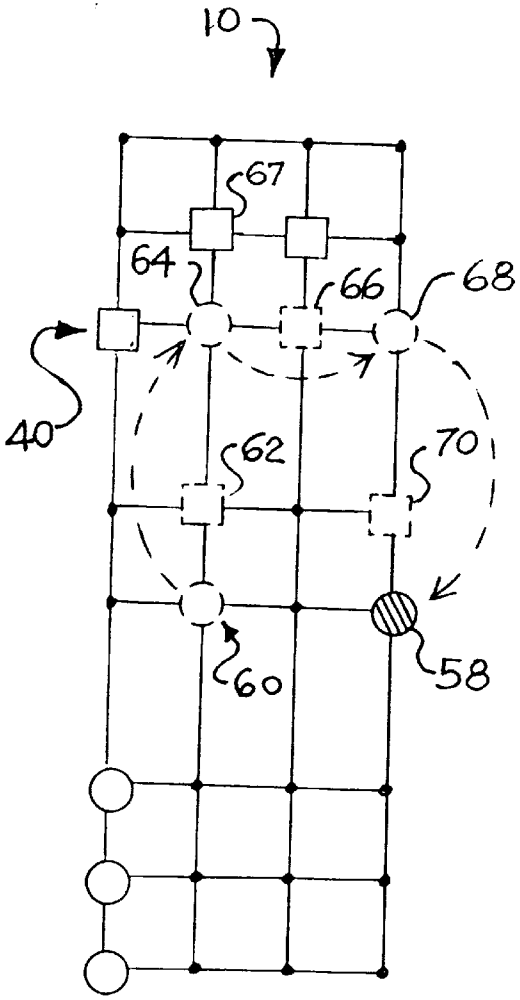
FIG. 5 is a top plan view of the board of FIG. 1, showing an advanced stage of play, and illustrating a complex jump.

FIG. 5 shows a slightly different situation wherein a playing piece 58 jumps more than one of the opponent's playing pieces. Just as a player must make a move wherein he or she jumps an opponent's playing piece rather than selecting a move wherein no jump occurs, so must a player continue a move by jumping each additional opposing playing piece in the manner proscribed for jumping the first opposing playing piece. Alternatively stated, a player is required to make the maximum number of jumps available. This holds true regardless of whether the playing piece making the jump and the playing pieces being jumped are initial playing pieces or promoted playing pieces. The step of requiring an initial playing piece to jump over an opposing playing piece is mandatory even when an opportunity exists to select another move wherein the player undertaking a move could avoid jumping any of the opponent's playing pieces. The only exception to the rule mandating jumps is that the player who would otherwise be obliged to jump may alternatively elect an optional penalty which will avoid necessity of making the jump.

Ignoring for now the optional penalty, and in order to illustrate jumps, in the example of FIG. 5, playing piece 58, which has begun its move from the vacated playing location indicated in broken lines as circle 60, continues its move after jumping a playing piece 62, which is removed after being jumped. Playing piece 58 momentarily alights on unoccupied space 64, then turns to move laterally to jump an additional playing piece 66. It should be noted that after the first jump, playing piece 58 occupies row 40, which demarcates a promotion area. At this point in the move, playing piece 58 becomes a promoted playing piece and continues its move. After alighting on unoccupied space 68, piece 58 jumps a final opposing playing piece 70. The move ends after playing piece 58 has moved six playing locations and comes to a stop two playing locations away from its initial position prior to this move. It will be noted that in making the maximum number of available jumps, piece 58 may not jump opposing piece 67, after which the move would end after taking only two pieces. Rather, respecting the rule regarding maximum number of pieces being jumped, piece 58 is constrained to make the move depicted in FIG. 5.

Figure 7:
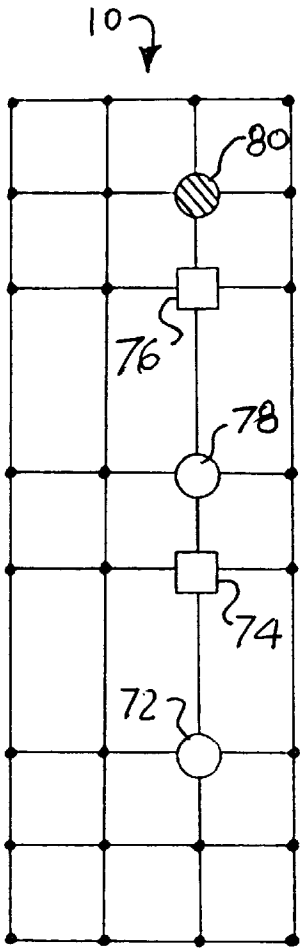
FIG. 7 is similar to FIG. 6, but shows the stage of play after selection of an optional penalty.
Figure 6:
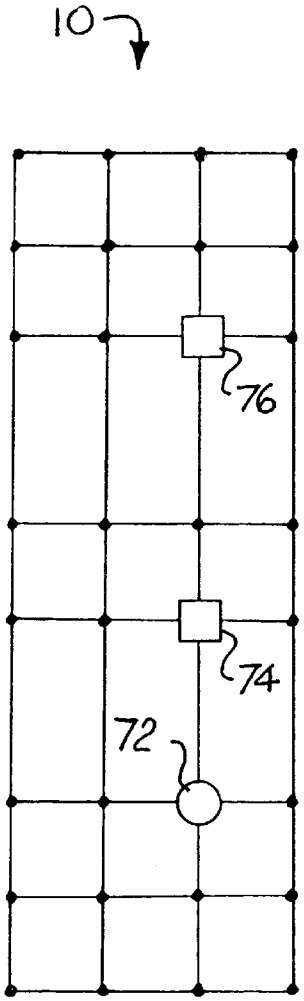
FIG. 6 is a top plan view of the board of FIG. 1, showing an advanced stage of play, and illustrating a game situation wherein an optional penalty situation exists.

FIG. 6 illustrates an option wherein a player forgoes a move including jumping, and instead accepts a penalty. In the situation of FIG. 6, it is the move of the player having playing piece 72. Normally, playing piece 72 would be obliged to jump playing pieces 74 and 76 of the opponent. This would end the game and award victory to the opponent. The player having piece 72 has the option of refusing to make the jumps of the playing pieces of the opponent where an opportunity for a jump exists. Instead, the player exercising the option must place one of his or her previously jumped playing pieces on the array for each one of the playing pieces of the opponent which could have been jumped. Alternatively stated, a player must return to the board that number of playing pieces equal to the maximum number of opponent's pieces which may be legally jumped. The option has the effect of increasing the number of his or her playing pieces on the array, but gives the player an opportunity to attempt to win in subsequent play. FIG. 7 illustrates the situation prevailing after exercise of this option, wherein playing pieces 78 and 80 have been restored to play. The penalty also is applied subject to the rule maximizing the number of pieces which must be jumped. As applied to the penalty, the number of pieces restored to the board is equivalent to the maximum number of pieces that could have been jumped in the move declined in favor of the penalty. The option is subject to being disallowed if exercising the option would result in repeating similar moves, thereby denying progress towards an end of the game.

It should be stated that the option to accept the penalty in place of making an otherwise mandatory jump exists only when a playing piece occupies row 36 of forwardmost playing locations. For the opponent, when it is the opponent's turn to move and the opponent is faced with a corresponding situation wherein he or she must jump or take the penalty, this stipulation would require that at least one of the opponent's pieces occupy row 40. In the examples of FIGS. 4 and 5, the player having pieces 54 and 58 could invoke the optional penalty. However, only for the purpose of illustrating simple and compound jumping moves, the examples shown in FIGS. 4 and 5 have ignored the penalty option.

Figure 8:
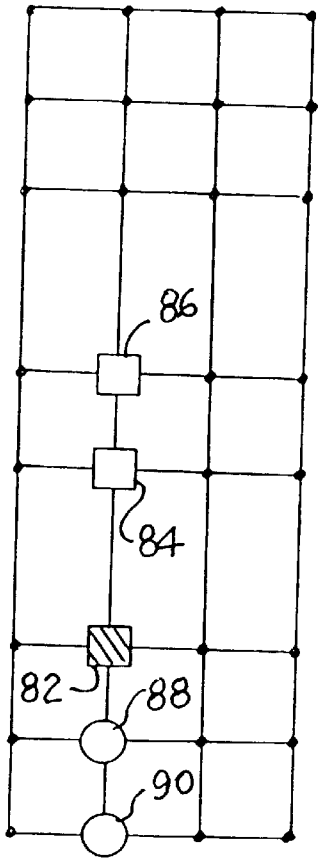
FIG. 8 is a top plan view of the board of FIG. 1, showing an advanced stage of play, and illustrating a situation wherein one player encounters a mandatory move option.

FIG. 8 illustrates a situation wherein a player is prevented from making a legal move due to obstruction by the opponent's playing pieces. In FIG. 8, playing pieces 82, 84, and 86 of the opponent prevent the player having playing pieces 88 and 90 from moving. It will be recalled that initial playing pieces are constrained to move only forwardly until they attain row 36 (in the case of the player having playing pieces 88, 90), or row 40 (in the case of the player having playing pieces 82, 84, 86). Therefore, playing pieces 88 and 90 may not move laterally, although playing locations adjacent to playing pieces 88 and 90 are vacant. The player having playing pieces 88 and 90 makes no move. The opponent is then required on his or her subsequent move to move one of his or her playing pieces in a manner that will enable the opponent to move a formerly immobilized playing piece.

Figure 9:
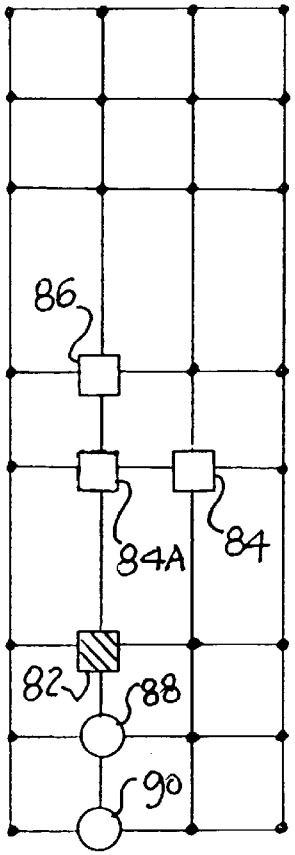
FIG. 9 is similar to FIG. 8, but shows the stage of play after selection of one move option.

In FIG. 9, the player having playing pieces 82, 84, 86 has moved piece 84 from its initial position 84A to a playing location located laterally from the initial position 84A. This permits the player having playing pieces 88 and 90 to move. In particular, playing piece 88 can jump playing pieces 82 and 84 or alternatively playing pieces 82 and 86 after the move shown in FIG. 9.

Figure 10:
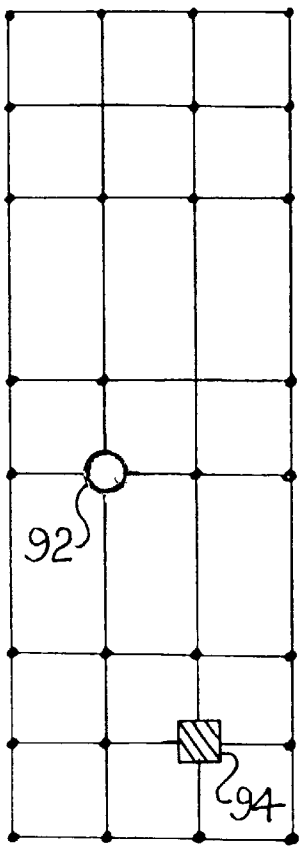
FIG. 10 is a top plan view of the board of FIG. 1, showing an advanced stage of play, and illustrating a forced win situation.

Play continues until all of the playing pieces of one player have been removed from play by having been jumped by the opponent. The player having all playing pieces removed is awarded victory. If both players each have only one promoted playing piece remaining and neither can force the other to jump, then the game is declared a draw. If each player has only one playing piece remaining, wherein one playing piece has been promoted and the other has not, then such situation will result in the player having the initial playing piece being declared the victor, as shown in the following example. As shown in FIG. 10, an initial playing piece 92 of one player and a promoted playing piece 94 of the opponent are the last playing pieces remaining on the array. Promoted playing piece 94 occupies a playing location such that a forward move (in the direction of playing piece 92) by promoted playing piece 94 will give the player having initial playing piece 92 an opportunity to move initial playing piece 92 to a playing location wherein promoted playing piece 94 will be obliged to jump initial playing piece 92 on its next move. As depicted, wherein it is the turn to move of the player having playing piece 94, the game situation favors the player having playing piece 92. Playing piece 92 apparently has a favorable response to the previously described forward move by the opponent, that is, to force a jump which ends the game in favor of the player having playing piece 92. In this situation, victory is awarded to the player having initial playing piece 92 rather than enabling playing piece 94 to escape by making a move other than forwardly towards playing piece 92.

The novel game is susceptible to variations and modifications which may be introduced thereto without departing from the inventive concept. For example, the number of rows and columns of playing locations and playing pieces may be modified. Playing locations may be modified from the array of straight rows and columns depicted herein, provided that playing locations are arrayed in series in two different directions, thereby enabling playing pieces to be moved selectively along different paths.

There is no necessity that the array be horizontally arranged. Illustratively, the array could be located on a surface arranged other than horizontally, with playing pieces having magnetic or other means for remaining in place. The game may also be played without using physical playing pieces. For example, the array and playing pieces may be reproduced on a cathode ray tube, liquid crystal display, or other flat screen or as any other movable display medium, may comprise light rays projected onto a surface, may be presented as a hologram, may printed on a printer, or may take any other desired form. The terms "array" and "playing piece" will therefore be understood to encompass symbolic representations thereof as well as encompassing printed, painted, or otherwise inscribed arrays, and actual playing pieces.

It is to be understood that the present invention is not limited to the embodiments described above, but encompasses any and all embodiments within the scope of the following claims.

I claim:

1. A method of playing a game by two players, comprising the steps of:

providing an array of playing locations each individually occupiable by one playing piece, wherein the playing locations form a plurality of rows of adjacent playing locations and a plurality of columns of adjacent playing locations such that the rows and columns of playing locations collectively form a first end of the playing field and a second end of the playing field maximally spaced apart from the first end by playing locations;

providing a plurality of initial playing pieces for each player, wherein each plurality of initial playing pieces is equal in number to the other plurality of initial playing pieces, and wherein each plurality of playing pieces is visually distinguishable from the other plurality of playing pieces;

placing the plurality of initial playing pieces of one player on playing locations at the first end of the array and placing the plurality of initial playing pieces of the other player at the second end of the array;

conducting play wherein the players alternatingly undertake moves, and wherein each move is limited to moving one playing piece;

constraining each initial playing piece to move a distance of one and only one playing location when only unoccupied playing locations are adjacent to the initial playing piece undertaking a move;

requiring an initial playing piece to jump over an opposing playing piece when, a) the opposing playing piece occupies a playing location adjacent to the initial playing piece undertaking the move, and when b) an unoccupied playing location exists adjacent to the playing piece being jumped along the same column or row occupied by the playing piece undertaking the jump move and the playing piece being jumped, wherein the playing piece undertaking the move being allowed when jumping to move a distance of two playing locations, wherein the initial playing piece undertaking the jump move must move to the unoccupied playing location and must either end its move by remaining on the unoccupied playing location or alternatively continues its move by jumping at least one additional opposing playing piece in the manner proscribed for jumping the first opposing playing piece, said step of requiring an initial playing piece to jump over an opposing playing piece being mandatory even when an opportunity exists to select another move wherein the player undertaking a move could avoid jumping any of the opponent's playing pieces;

constraining each initial playing piece to move only to an unoccupied playing location adjacent to and forward of that initial playing piece;

designating for each plurality of initial playing pieces a row initially occupied by opposing initial playing pieces as demarcating a promotion area comprising the end row of playing locations and also at least one additional row of playing locations;

promoting each initial playing piece which is moved to the promotion area of the opponent to a promoted playing piece which is empowered to move selectively backwardly and laterally as well as forwardly, while otherwise being constrained to move in the manner of initial playing pieces;

removing from play each initial playing piece and each promoted playing piece which has been jumped; and determining the end of the game by either awarding victory to the player who has forced his or her opponent to jump and consequently remove all of his or her playing pieces, wherein victory is awarded to the player having no playing pieces remaining, or by declaring a draw in a situation wherein each player has only one playing piece remaining.

2. The method of playing a game according to claim 1, comprising a further step of enabling each initial playing piece which has moved forwardly of those playing locations occupied by its own initial playing pieces prior to the first move of the game to move selectively both forwardly and laterally.

3. The method of playing a game according to claim 1, wherein said step of providing an array comprises the further step of providing a board inscribed with the array of playing locations.

4. The method of playing a game according to claim 1, wherein said step of requiring each initial playing piece to move a distance exceeding one playing location by jumping when an opposing playing piece occupies a playing location adjacent to the initial playing piece undertaking the move comprises the further step of requiring each initial playing piece to make the maximum number of jumps available.

5. The method of playing a game according to claim 1, wherein an initial playing piece may move forwardly, laterally or backwardly when jumping an opponent's piece, in performing said step of requiring an initial playing piece to jump over an opposing playing piece.

6. The method of playing a game according to claim 5, comprising the further step of disallowing the option of refusing to jump a playing piece of the opponent where an opportunity for a jump exists if exercising the option would result in repeating similar moves by both players.

7. The method of playing a game according to claim 1, comprising the further step of requiring that a player whose playing pieces obstruct all moves of the opponent to move one of his or her playing pieces at his or her next move in a manner that will enable the opponent to move a playing piece on the opponent's subsequent move.

8. The method of playing a game according to claim 1, wherein said step of determining the end of the game comprises a further step of awarding victory to the player having only an initial playing piece remaining on the array when a situation exists wherein the opponent has only a promoted playing piece remaining on the array, and the promoted playing piece occupies a playing location such that a forward move by the promoted playing piece will give the player having the initial playing piece an opportunity to move the initial playing piece to a playing location wherein the promoted playing piece will be obliged to jump the initial playing piece on its next move.

9. The method of playing a game according to claim 1, wherein said step of providing an array of playing locations comprises the further step of providing an array of four columns and eight rows of playing locations, thereby establishing thirty-two playing locations, with one row being the first end of the array and the farthest row therefrom being the second end of the array.

10. The method of playing a game according to claim 9, wherein said step of providing a plurality of initial playing pieces for each player comprises the further step of providing for each player twelve initial playing pieces disposed upon one end row of playing locations and on the two adjacent rows of playing locations.

11. A method of playing a game by two players, comprising the steps of:

providing an array of playing locations each individually occupiable by one playing piece, wherein the playing locations form a plurality of rows of adjacent playing locations and a plurality of columns of adjacent playing locations such that the rows and columns of playing locations collectively form a first end of the playing field and a second end of the playing field maximally spaced apart from the first end by playing locations;

providing a plurality of initial playing pieces for each player, wherein each plurality of initial playing pieces is equal in number to the other plurality of initial playing pieces, and wherein each plurality of playing pieces is visually distinguishable from the other plurality of playing pieces;

placing the plurality of initial playing pieces of one player on playing locations at the first end of the array and placing the plurality of initial playing pieces of the other player at the second end of the array;

conducting play wherein the players alternatingly undertake moves, and wherein each move is limited to moving one playing piece;

constraining each initial playing piece to move a distance of one and only one playing location when only unoccupied playing locations are adjacent to the initial playing piece undertaking a move;

requiring an initial playing piece to jump over an opposing playing piece when, a) the opposing playing piece occupies a playing location adjacent to the initial playing piece undertaking the move, and when b) an unoccupied playing location exists adjacent to the playing piece being jumped along the same column or row occupied by the playing piece undertaking the jump move and the playing piece being jumped, wherein the playing piece undertaking the move being allowed when jumping to move a distance of two playing locations, wherein the initial playing piece undertaking the jump move must move to the unoccupied playing location and must either end its move by remaining on the unoccupied playing location or alternatively continues its move by jumping at least one additional opposing playing piece in the manner proscribed for jumping the first opposing playing piece, said step of requiring an initial playing piece to jump over an opposing playing piece being mandatory even when an opportunity exists to select another move wherein the player undertaking a move could avoid jumping any of the opponent's playing pieces;

constraining each initial playing piece to move only to an unoccupied playing location adjacent to and forward of that initial playing piece;

designating for each plurality of initial playing pieces a row initially occupied by opposing initial playing pieces as demarcating a promotion area;

promoting each initial playing piece which is moved to the promotion area of the opponent to a promoted playing piece which is empowered to move selectively backwardly and laterally as well as forwardly, while otherwise being constrained to move in the manner of initial playing pieces;

removing from play each initial playing piece and each promoted playing piece which has been jumped;

giving a player whose turn it is to move an option wherein the player may refuse to jump a playing piece of the opponent where an opportunity for a jump exists, and must instead place one of his or her previously jumped playing pieces on the array for each one of the opponent's playing pieces that could have been jumped in the move, thereby increasing the number of his or her playing pieces on the array; and determining the end of the game by either awarding victory to the player who has forced his or her opponent to jump and consequently remove all of his or her playing pieces, wherein victory is awarded to the player having no playing pieces remaining, or by declaring a draw in a situation wherein each player has only one playing piece remaining.

12. The method of playing a game according to claim 11, comprising the further step of disallowing the option of refusing to jump a playing piece of the opponent where an opportunity for a jump exists if exercising the option would result in repeating similar moves by both players.

13. The method of playing a game according to claim 11, comprising a further step of enabling each initial playing piece which has moved forwardly of those playing locations occupied by its own initial playing pieces prior to the first move of the game to move selectively both forwardly and laterally.

14. The method of playing a game according to claim 11, wherein said step of providing an array comprises the further step of providing a board inscribed with the array of playing locations.

15. The method of playing a game according to claim 11, wherein said step of requiring each initial playing piece to move a distance exceeding one playing location by jumping when an opposing playing piece occupies a playing location adjacent to the initial playing piece undertaking the move comprises the further step of requiring each initial playing piece to make the maximum number of jumps available.

16. The method of playing a game according to claim 11, comprising the further step of requiring that a player whose playing pieces obstruct all moves of the opponent to move one of his or her playing pieces at his or her next move in a manner that will enable the opponent to move a playing piece on the opponent's subsequent move.

17. The method of playing a game according to claim 11, wherein said step of determining the end of the game comprises a further step of awarding victory to the player having only an initial playing piece remaining on the array when a situation exists wherein the opponent has only a promoted playing piece remaining on the array, and the promoted playing piece occupies a playing location such that a forward move by the promoted playing piece will give the player having the initial playing piece an opportunity to move the initial playing piece to a playing location wherein the promoted playing piece will be obliged to jump the initial playing piece on its next move.

18. The method of playing a game according to claim 11, wherein said step of providing an array of playing locations comprises the further step of providing an array of four columns and eight rows of playing locations, thereby establishing thirty-two playing locations, with one row being the first end of the array and the farthest row therefrom being the second end of the array.

19. The method of playing a game according to claim 18, wherein said step of providing a plurality of initial playing pieces for each player comprises the further step of providing for each player twelve initial playing pieces disposed upon one end row of playing locations and on the two adjacent rows of playing locations.

20. The method of playing a game according to claim 11, wherein an initial playing piece may move forwardly, laterally or backwardly when jumping an opponent's piece, in performing said step of requiring an initial playing piece to jump over an opposing playing piece.

* * * * *